US007587148B2

(12) United States Patent
Yamaguchi

(10) Patent No.: US 7,587,148 B2
(45) Date of Patent: Sep. 8, 2009

(54) IMAGE FORMATION APPARATUS, AN IMAGE FORMATION METHOD, AN IMAGE FORMATION PROGRAM, AND A RECORDING MEDIUM

(75) Inventor: Yasuo Yamaguchi, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 228 days.

(21) Appl. No.: 11/826,737

(22) Filed: Jul. 18, 2007

(65) Prior Publication Data

US 2008/0019744 A1 Jan. 24, 2008

(30) Foreign Application Priority Data

Jul. 21, 2006 (JP) ..... 2006-199470

(51) Int. Cl.
*G03G 15/00* (2006.01)
*G03G 21/14* (2006.01)

(52) U.S. Cl. ..... 399/46; 399/76; 399/167

(58) Field of Classification Search ..... 399/69, 399/76, 167, 68, 67, 46
See application file for complete search history.

(56) References Cited

U.S. PATENT DOCUMENTS

2007/0092297 A1* 4/2007 Shimura et al. ..... 399/167
2007/0098426 A1* 5/2007 Soya ..... 399/67
2007/0127948 A1* 6/2007 Akiyama ..... 399/167

FOREIGN PATENT DOCUMENTS

JP 2004-138840 5/2004
JP 2006-126502 5/2006

* cited by examiner

*Primary Examiner*—David M Gray
*Assistant Examiner*—Rodney Bonnette
(74) *Attorney, Agent, or Firm*—Harness, Dickey & Pierce, P.L.C.

(57) ABSTRACT

An image formation apparatus, an image formation method, an image formation program, and a recording medium are disclosed. The image formation apparatus includes a first driving source for driving a feed roller and a fixing unit, a second driving source for driving at least one of plural photo conductors and a middle transfer belt, and a third driving source for driving the photo conductors other than the photo conductor driven by the second driving source. The image formation apparatus further includes a temperature detecting unit for determining whether temperature of the fixing unit is greater than a predetermined threshold value, and a control unit for driving the driving sources in different sequences according to a result of the determination.

18 Claims, 8 Drawing Sheets

IMAGE FORMATION APPARATUS, AN IMAGE FORMATION METHOD, AN IMAGE FORMATION PROGRAM, AND A RECORDING MEDIUM

BACKGROUND OF THE INVENTION

1. Field of the Invention

The present invention relates to an image formation apparatus, an image formation method, an image formation program, and a recording medium, wherein driving sources are started in different sequences.

2. Description of the Related Art

Conventionally, an image formation apparatus includes a current detecting unit arranged in a power-source line to which two or more functional units are connected, where the current detecting unit measures a starting current when each of the functional units is started so that a peak of current consumption by an overlap of the starting currents may be controlled by adjusting starting timing of the functional units based on a measurement result (for example, Patent Reference 1).

[Patent Reference 1] JPA 2004-138840

DISCLOSURE OF INVENTION

Objective of the Invention

However, according to a technique disclosed by Patent Reference 1, only the starting timing is controlled according to the magnitude of the current measured by the current detecting unit, while the functional units are started in a predetermined sequence. For example, a fixing unit is started earlier in the predetermined sequence despite the fixing unit having not reached a predetermined temperature. This delays printing operations, and causes wasteful power consumption.

SUMMARY OF THE INVENTION

The present invention provides an image formation apparatus, an image formation method, an image formation program, and a recording medium that substantially obviate one or more of the problems caused by the limitations and disadvantages of the related art.

According to the image formation apparatus, the image formation method, the image formation program, and the recording medium of the present invention, the sequence of starting driving sources is adjusted depending on situations.

Features of embodiments of the present invention are set forth in the description that follows, and in part will become apparent from the description and the accompanying drawings, or may be learned by practice of the invention according to the teachings provided in the description. Problem solutions provided by an embodiment of the present invention may be realized and attained by an image formation apparatus, an image formation method, an image formation program, and a recording medium particularly pointed out in the specification in such full, clear, concise, and exact terms as to enable a person having ordinary skill in the art to practice the invention.

To achieve these solutions and in accordance with an aspect of the invention, as embodied and broadly described herein, an embodiment of the invention provides an image formation apparatus, an image formation method, an image formation program, and a recording medium as follows.

Means for Solving the Problem

The image formation apparatus according to the embodiment comprises:

a first driving source for driving a feed roller and a fixing unit;

a second driving source for driving at least one photo conductor out of two or more photo conductors and a middle transfer belt;

a third driving source for driving photo conductors other than the photo conductor driven by the second driving source;

a temperature detecting unit for detecting temperature of the fixing unit, and for determining whether the temperature is greater than a predetermined threshold value; and a control unit for starting the first driving source, the second driving source, and the third driving source in this sequence if the temperature detecting unit determines that the temperature of the fixing unit is greater than the predetermined threshold value.

According to an aspect of the embodiment, the image formation apparatus further comprises:

a current detecting unit for detecting a current flowing through the first driving source, the second driving source, and the third driving source, and for determining whether the current is stabilized; wherein the control unit starts driving the first driving source, the second driving source, and the third driving source in this sequence every time the current flowing through the corresponding preceding driving source is determined to have been stabilized if the temperature detecting unit determines that the temperature of the fixing unit is greater than the predetermined threshold value.

According to another aspect of the embodiment, the control unit of the image formation apparatus starts driving the second driving source, the third driving source, and the first driving source in this sequence if the temperature detecting unit determines that the temperature of the fixing unit is less than the predetermined threshold value.

According to another aspect of the embodiment, the control unit of the image formation apparatus starts driving the second driving source and the first driving source in this sequence if a monochrome printing request is received.

According to another aspect of the embodiment, the control unit of the image formation apparatus starts driving the second driving source, the third driving source, and the first driving source in this sequence if a color printing request is received.

According to another aspect of the embodiment, each of the first driving source, the second driving source, and the third driving source includes a DC brushless motor.

The embodiment further provides an image formation method for the image formation apparatus described above.

The embodiment further provides a computer-executable program for carrying out the image formation method.

The embodiment further provides a computer-readable recording medium that stores the computer-executable program.

EFFECTIVENESS OF INVENTION

According to the image formation apparatus, the image formation method, the image formation program, and the recording medium, the driving sources are started in a sequence appropriate in various situations so that a power source having a small output current capacity can be used without a shutdown due to excessive starting current. In this way, power-source cost is decreased without delaying the printing operations.

DESCRIPTION OF THE PREFERRED EMBODIMENTS

Figure 1:
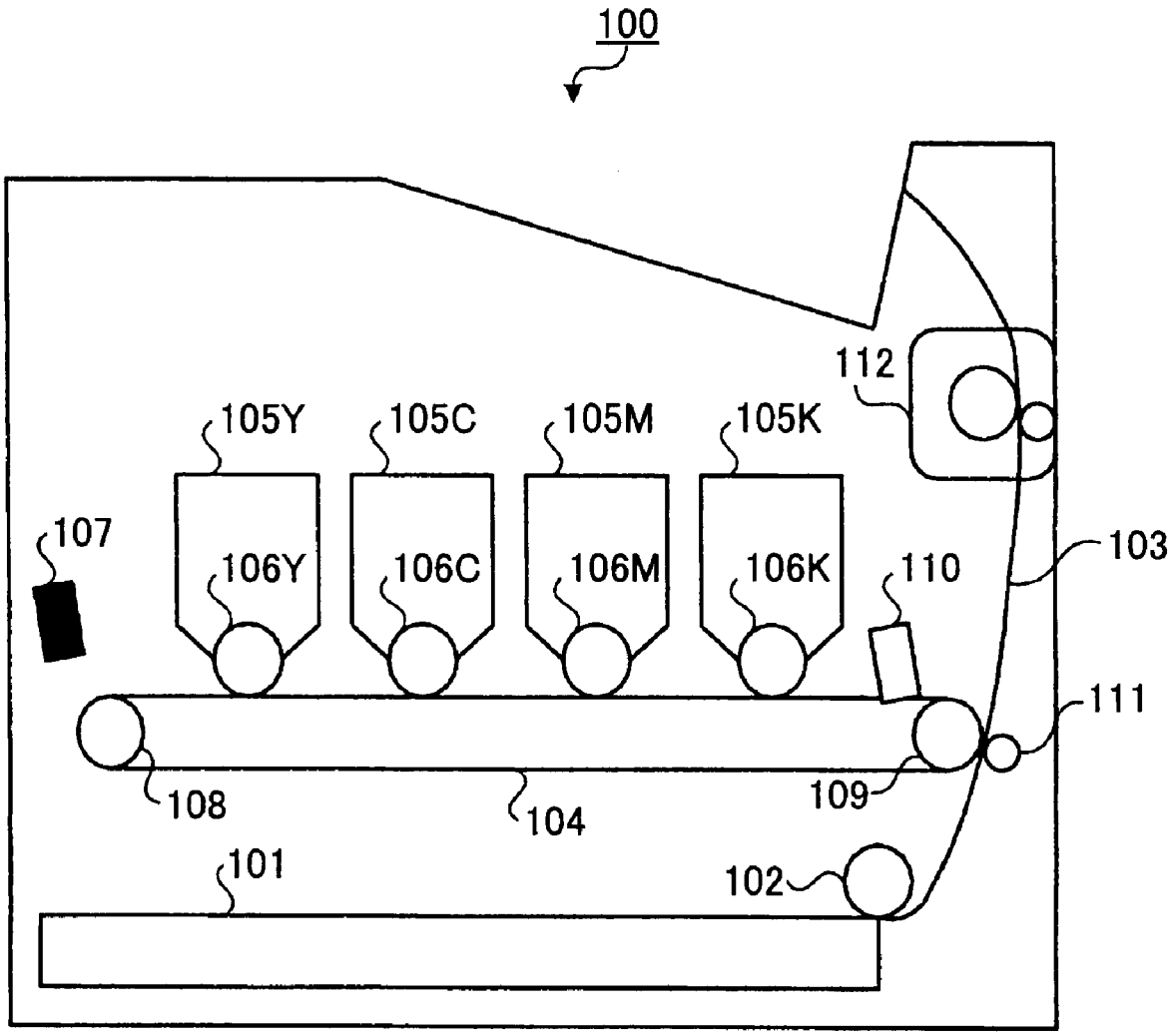
FIG. 1 is a cutaway drawing of an image formation apparatus according to the embodiment of the present invention.

In the following, embodiments of an image formation apparatus, an image formation method, an image formation program, and a recording medium of the present invention are described with reference to the accompanying drawings.

Embodiments (Overall Configuration of the Image Formation Apparatus)

First, the configuration of an image formation apparatus 100 according to the embodiment of the present invention is described with reference to FIG. 1. The image formation apparatus 100 includes a feed cassette 101, a feed roller 102, a conveyance way 103, a middle transfer belt 104, development units 105K, 105C, 105M, and 105Y (they are collectively called 105, which nomenclature system applies to other functional units), photo conductors 106 (K, C, M, Y), a sensor 107, a tension roller 108, a driving roller 109, a cleaning unit 110, a secondary transfer roller 111, and a fixing unit 112.

The feed cassette 101 stores sheets of paper before printing. The feed roller 102 feeds the paper stored in the feed cassette 101 to the conveyance way 103 sheet by sheet from the top. Each of the sheets is conveyed to the secondary transfer roller 111 at timing at which an image on the middle transfer belt 104 is transferred to the sheet. The middle transfer belt 104 is wound around the driving roller 109 and the tension roller 108. The middle transfer belt 104 is driven by the driving roller 109, and sag is prevented by the tension roller 108.

The image formation apparatus 100 is a so-called tandem type, wherein the development units (105K, 105M, 105C, 105Y) for different colors are arranged along with the middle transfer belt 104. The colors have complementary-color relations. "K" stands for black, "M" stands for magenta, "C" stands for cyan, and "Y" stands for yellow. The development units (105K, 105M, 105C, and 105Y) include corresponding photo conductors (106K, 106M, 106C, and 106Y, respectively) for supporting toner images in the corresponding colors.

With reference to FIG. 1, the middle transfer belt 104 rotates counterclockwise, and the development units 105K, 105M, 105C, and 105Y are arranged in this sequence from upstream side to downstream side. The development units 105K, 105M, 105C, and 105Y are structured the same, but form toner images in different colors. In the following, all the development units and all the photo conductors are called the development unit 105 and the photo conductor 106, respectively, where descriptions are commonly applicable.

For forming an image, the photo conductor 106 is uniformly charged on its perimeter. Then, a laser light corresponding to an image of a color is irradiated to the perimeter of the photo conductor 106, and the uniform charge is exposed according to the image. That is, an electrostatic latent image is formed. Then, toner of each color is applied to the photo conductor 106 such that a toner image in the color is formed, which toner image is visible.

The toner image is transferred to the middle transfer belt 104 with a primary transfer roller that is not illustrated at a primary transfer location where the photo conductor 106 meets the middle transfer belt 104. That is, the toner image is transferred to the middle transfer belt 104.

Specifically, first, a toner image in black is transferred to the middle transfer belt 104 by the development unit 105K, and then is conveyed to the next development unit 105M if color printing is requested. Then, a toner image in magenta is formed on the photo conductor 106M of the development unit 105M through the same image formation process of the development unit 105K. The toner image in magenta is transferred to the middle transfer belt 104 such that the toner image in magenta is superposed onto the toner image in black.

The middle transfer belt 104 is further conveyed to the following development units 105C and 105Y, and a toner image in cyan formed on the photo conductor 106C and the toner image in yellow formed on the photo conductor 106Y are transferred and superposed onto the middle transfer belt 104 by the same operation as described above. By the process described above, a full color image is formed on the middle transfer belt 104. The middle transfer belt 104 bearing the full color is conveyed to the secondary transfer roller 111, and the full color image is transferred from the middle transfer belt 104 to the paper. The sensor 107, which includes a luminous source and an optical receiver component, reads a pattern image on the middle transfer belt 104. Further, unnecessary toner that remains on the middle transfer belt 104 without being transferred to the paper after transfer of the color image is removed by the cleaning unit 110, and the middle transfer belt 104 stands by for the next image formation.

Then, the color image is fixed to the paper by thermal fusion by the fixing unit 112. The fixing unit 112 is heated by a driving source (not illustrated), and operates when the temperature of the fixing unit 112 is greater than a threshold value. The paper, to which the color image is fixed and adhered by the fixing unit 112, is discharged out of the image formation apparatus 100.

In addition, if monochrome printing (that is, printing only in black) is requested, the photo conductors 106M, 106C, and 106Y are separated from the middle transfer belt 104 so that the image formation process is performed only for the black color.

(Configuration of the Driving Sources)

Figure 2:
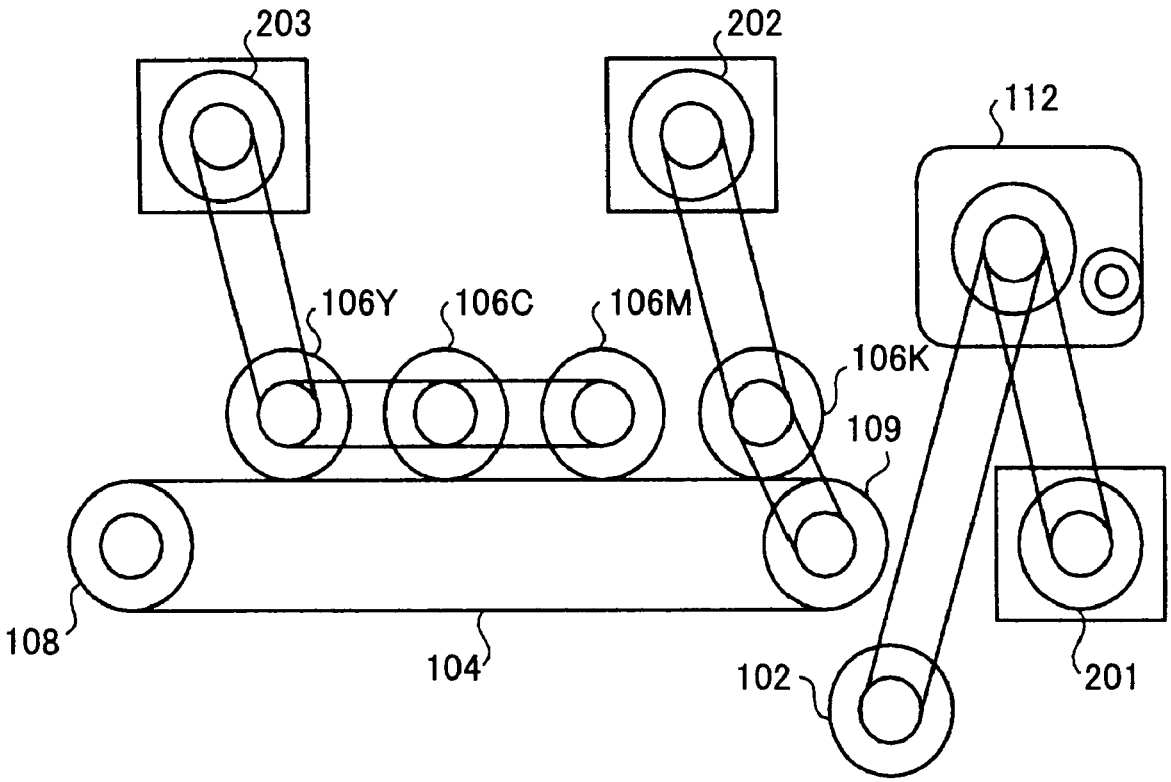
FIG. 2 is a schematic drawing showing the configuration of driving sources of the image formation apparatus.

Next, driving sources that drive various parts of the image formation apparatus 100 are described with reference to FIG. 2. The image formation apparatus 100 includes a first driving source 201 for driving the feed roller 102 and the fixing unit 112, a second driving source 202 for driving the driving roller 109 (for driving the middle transfer belt 104), and at least one of the photo conductors (the photo conductor 106K in an example shown in FIG. 2), and a third driving source 203 for driving the remaining photo conductors (the photo conductors 106C, 106M, and 106Y in FIG. 2) that are not driven by other driving sources.

(Hardware Configuration)

Figure 3:
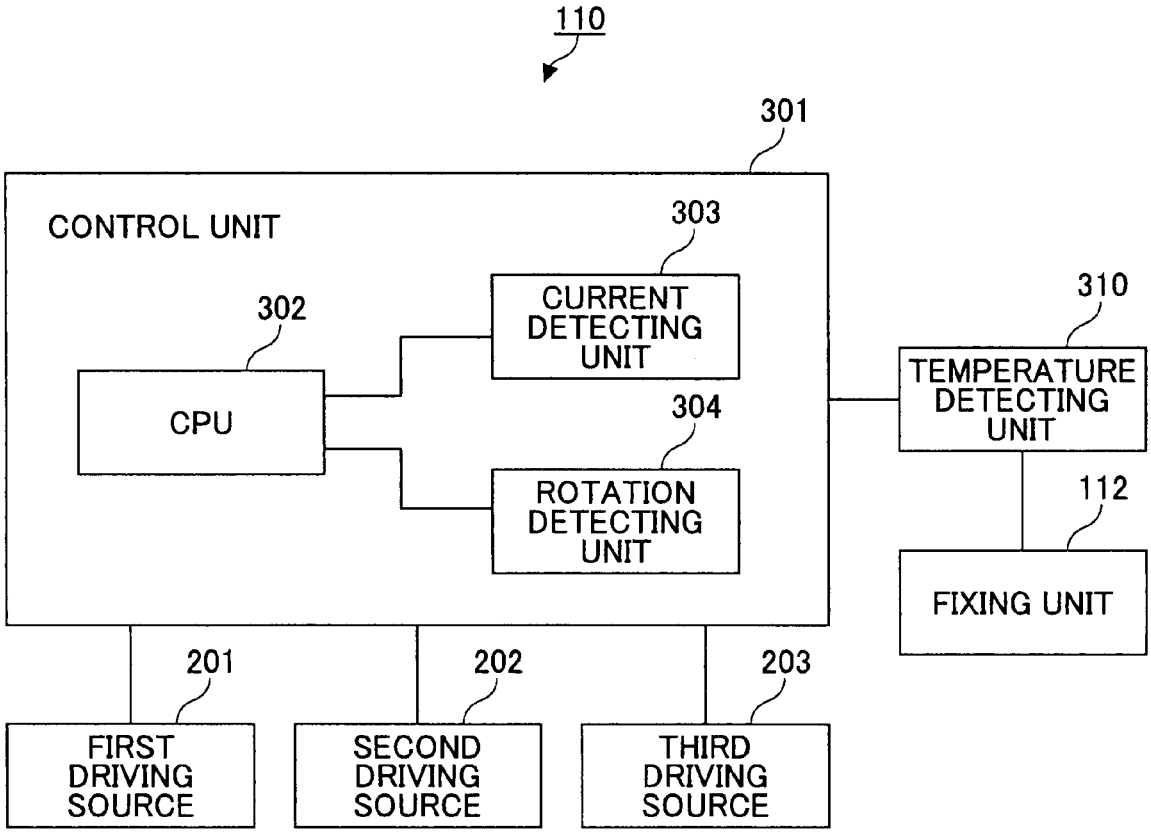
FIG. 3 is a block diagram showing the hardware configuration of the image formation apparatus.

The hardware configuration of the image formation apparatus 100 is described with reference to FIG. 3. The image formation apparatus 100 includes a control unit 301, a temperature detecting unit 310, the fixing unit 112, the first driving source 201, the second driving source 202, and the third driving source 203. Functional units that have been described with reference to FIGS. 1 and 2 bear the same reference numbers, and descriptions are not repeated.

The control unit 301 includes a CPU 302, a current detecting unit 303, and a rotation detecting unit 304. The CPU 302 is for controlling the image formation apparatus 100. The CPU 302 controls the first driving source 201, the second driving source 202, and the third driving source 203 based on a detection result of the current detecting unit 303, the rotation detecting unit 304, and the temperature detecting unit 310 (details are described below).

The current detecting unit 303 detects whether a current flowing through each driving source is stabilized. The rotation detecting unit 304 detects whether the rotation of each driving source is stabilized. The temperature detecting unit 310 detects whether the temperature of the fixing unit 112 is greater than a predetermined threshold value.

(An Example of the Current Flowing Through the Driving Source)

Figure 4:
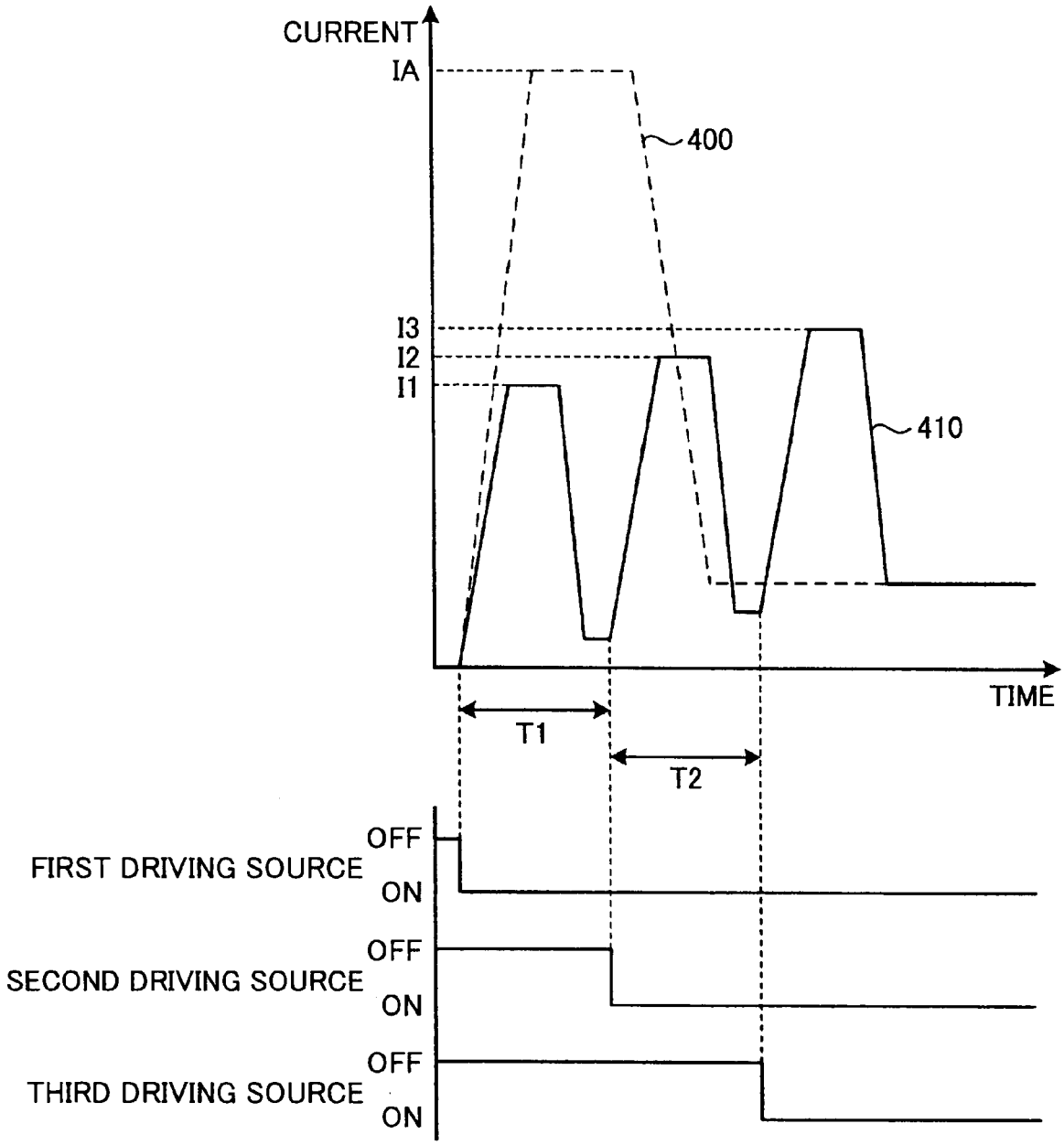
FIG. 4 is a graph showing an example of currents flowing through the driving sources.

Next, an example of the current flowing through the driving sources detected by the current detecting unit 303 is described with reference to FIG. 4, wherein the horizontal axis represents the time, and the vertical axis represents the current. In FIG. 4, a dotted line 400 shows the magnitude of the current if the first driving source 201, the second driving source 202, and the third driving source 203 are simultaneously started. Here, it is shown that a current IA is required.

A solid line 410 shows the magnitude of the current when the first driving source 201, the second driving source 202, and the driving source 203 are started in sequence at predetermined intervals T1 and T2. The solid line 410 also shows that the starting current of the first driving source 201 is I1, a current I2 is required at the time of starting the second driving source 202, and a current value I3 is required at the time of starting the third driving source 203. The current I3 is smaller than the current IA required when all the driving sources 201, 202, and 203 are simultaneously started.

By staggering the starting of the driving sources 201, 202, and 203 as described above, the total current requirement of the image formation apparatus 100 can be decreased, and a power source with a smaller current capacity may be used without causing a shutdown due to an excessive current draw.

(An Example of Initialization Sequence)

Figure 5:
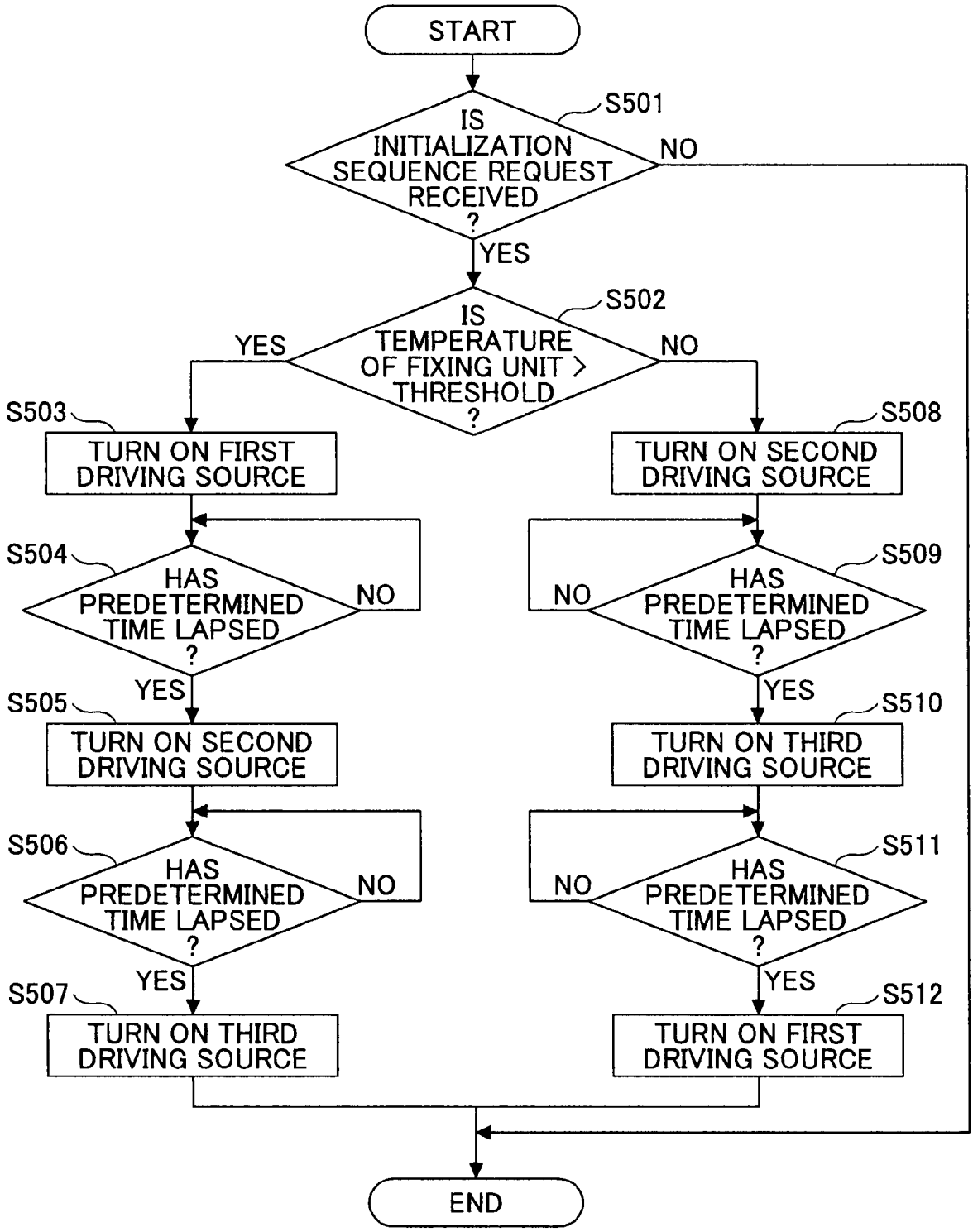
FIG. 5 is a flowchart of an example of an initialization sequence of an image formation process.

Below, an example of the image formation process carried out by the image formation apparatus 100 is described. FIG. 5 is a flowchart of an example of the image formation process in the case of an initialization sequence. In FIG. 5, first, it is determined whether an initialization sequence request is received (step S501). When an initialization sequence request is received (step S501: Yes), the temperature detecting unit 310 determines whether the temperature of the fixing unit 112 is greater than a predetermined threshold (step S502). Since the fixing unit 112 does not operate until the temperature becomes greater than a predetermined temperature, the fixing unit 112 is not started until its temperature is raised to the predetermined temperature by another driving source (not illustrated). If the temperature of the fixing unit 112 is greater than the threshold value (step S502: Yes), the first driving source 201 is turned on (step S503).

Then, after turning on the first driving source 201 at step S503 the process waits for a predetermined time at step S504 (a waiting loop is formed if No). If the time is up (step S504: Yes), the second driving source 202 is turned on (step S505).

Then, after turning on the second driving source 202 at step S505 the process waits for a predetermined time (step S506: a waiting loop is formed if No). If the time is up (step S506: Yes), the third driving source 203 is turned on (step S507), and the process is finished.

Here, the predetermined times may be different from driving source to driving source, and may be determined based on experiments with the different driving sources. For example, by the experiments, starting time until the current is stabilized is measured with the current detecting unit 303 for every driving source.

On the other hand, when the temperature of the fixing unit 112 is not greater than the threshold value (step S502: No), the second driving source 202 is turned on (step S508). Then, after turning on the second driving source 202 at step S208 the process waits (step S509) for a predetermined time (a waiting loop is formed if NO). If the time is up (step S509: Yes), the third driving source 203 is turned on (step S510).

Then, after turning on the third driving source 203 at step S510 the process waits (step S511) for a predetermined time (a waiting loop is formed if No). If the time is up (step S511: Yes), the first driving source 201 is turned on (step S512), and the process is finished.

Further, if there is no initialization sequence request at step S501 (step S501: No), the process is finished with no actions.

As described, at step S504, step S506, step S509, and step S511, whether the corresponding predetermined time has passed is determined; however, timing for turning on the next driving source may be determined in other ways. For example, if the current detecting unit 303 determines that the current is stabilized after starting, the next driving source is turned on.

Further, at step S504, step S506, step S509, and step S511, whether the corresponding predetermined time has passed is determined; however, timing for turning on the next driving source may be determined in other ways. For example, if the rotation detecting unit 304 detects the rotational speed of a motor driven by each driving source, and determines that the rotational speed is greater than a predetermined speed, the next driving source is turned on.

(Example of Process when Receiving a Color Printing Request)

Figure 6:
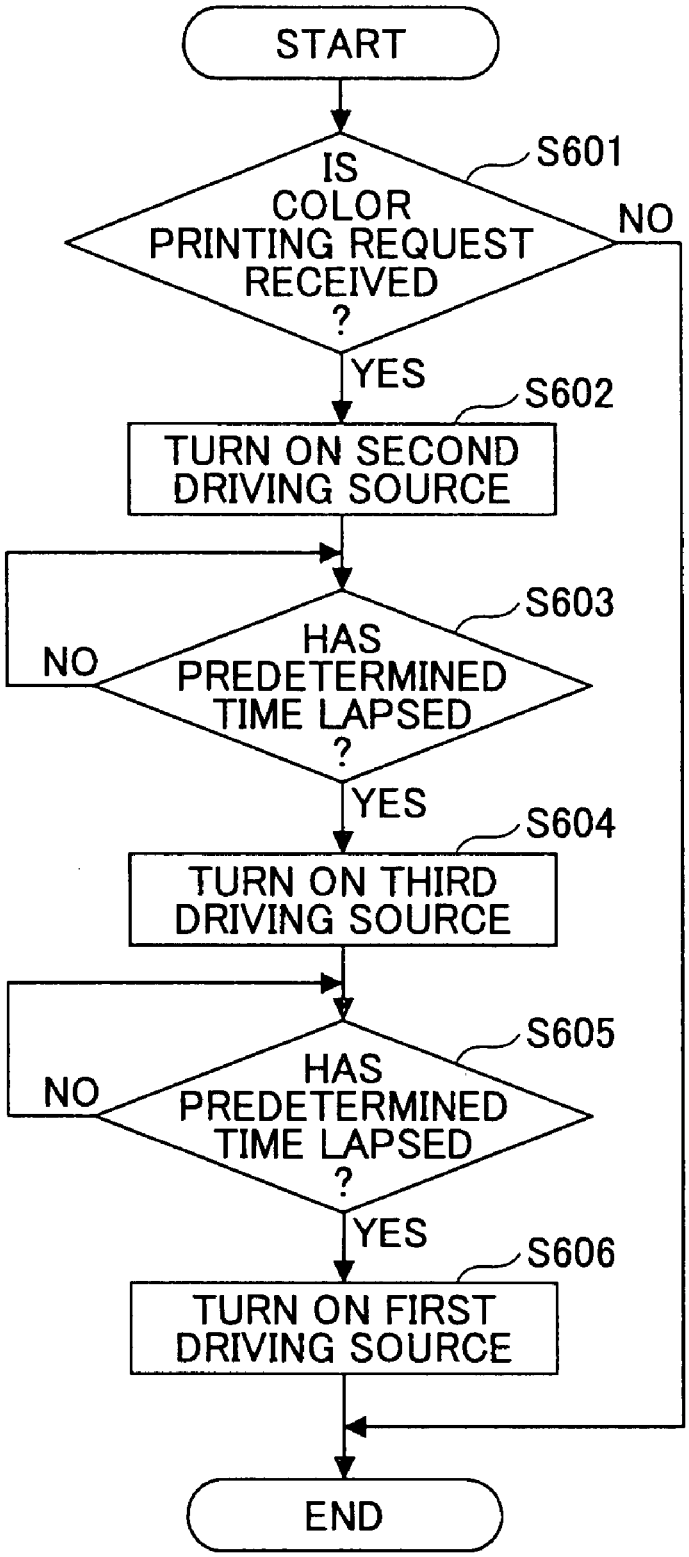
FIG. 6 is a flowchart of an example of the image formation process when receiving a color printing request.

Below, another example of the image formation process of the image formation apparatus 100 is described with reference to FIG. 6, which process is carried out when a color printing request is received. First, it is determined whether a color printing request is received (step S601).

If the determination is affirmative, i.e., a color printing request is received at step S601 (step S601: Yes), the second driving source 202 is turned on first (step S602). After turning on the second driving source 202 the process waits for a predetermined time (step S603 No: a waiting loop is formed). If the time is up (step S603: Yes), the third driving source 203 is turned on (step S604).

Then, after turning on the third driving source 203 at step S604 the process waits for a predetermined time (step S605 NO: a waiting loop is formed). If the time is up (step S605: Yes), the first driving source 201 is turned on (step S606), and the process is finished. On the other hand, at step S601, if no color printing request is received (step S601: No), the process is finished with no actions.

(Example of Process when Receiving a Monochrome Printing Request)

Figure 7:
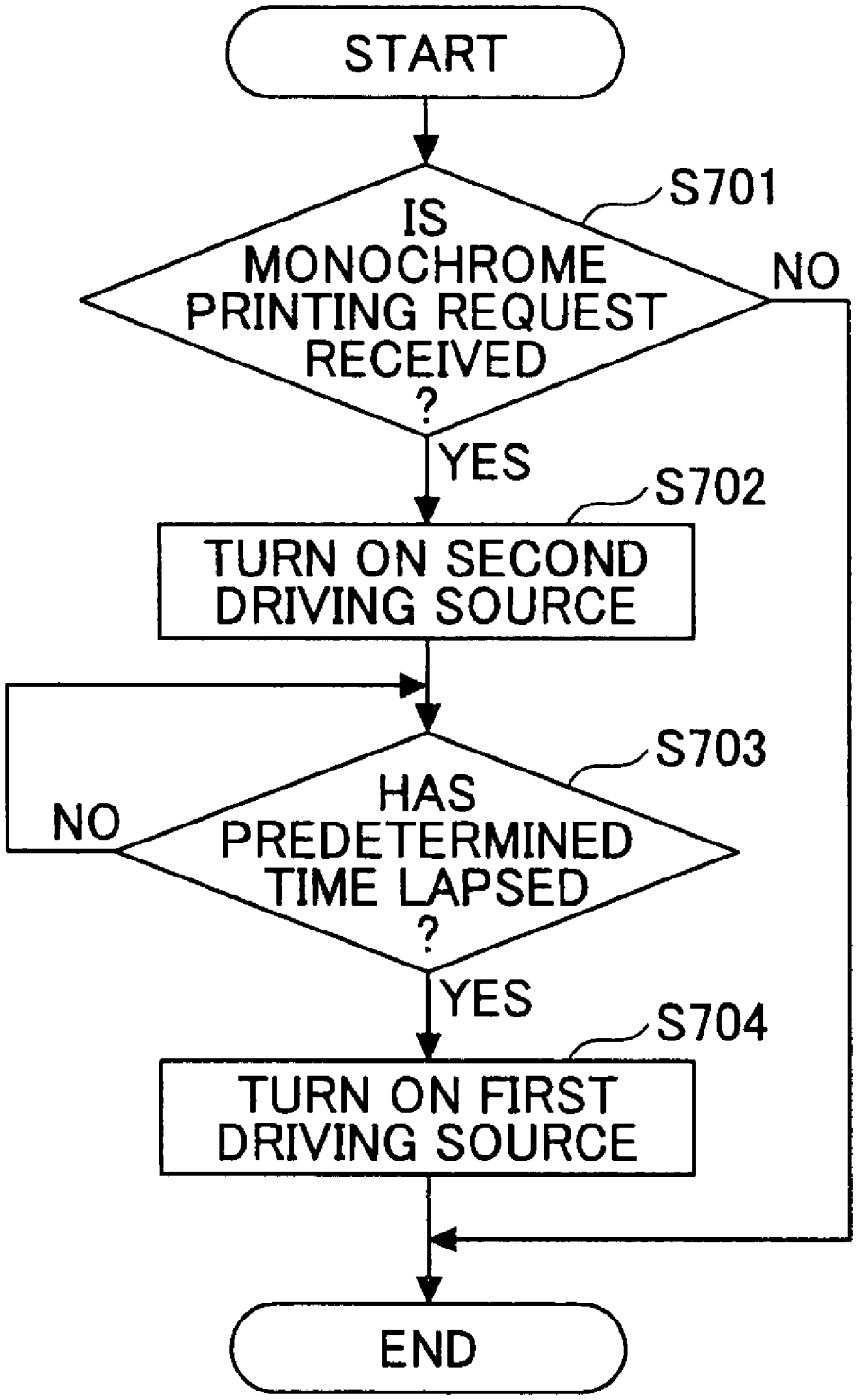
FIG. 7 is a flowchart of an example of the image formation process when receiving a monochrome printing request.

Below, another example of the image formation process of the image formation apparatus 100 is described with reference to FIG. 7, which process is carried out when receiving a monochrome printing request. First, it is determined whether a monochrome printing request is received (step S701). Since monochrome printing usually uses only the photo conductor 106K for the black color, the third driving source 203 is not required to be driven. Further, the monochrome printing may be performed not necessarily by the photo conductor 106K for the black color, but by another photo conductor for a color other than black so long as the photo conductor is driven by the second driving source 202.

If a monochrome printing request is received at step S701 (step S701: Yes), the second driving source 202 is turned on (step S702). After turning on the second driving source 202 the process waits for a predetermined time (step S703 NO: a waiting loop is formed). If the time is up (step S703: Yes), the first driving source 201 is turned on (step S704), and the process is finished. On the other hand, if no monochrome printing request is received at step S701 (step S701: No), the process is finished with no actions.

(Example of Current Flowing Through Driving Sources when DC Brushless Motor is Used)

The image formation process when a DC brushless motor is used for each driving source is described with reference to FIG. 8. The horizontal axis represents the time, and the vertical axis represents the current. Further, a dashed line 800 shows the magnitude of the current when the first driving source 201, the second driving source 202, and the third driving source 203 are simultaneously started.

A solid 810 shows the magnitude of the current when the first driving source 201, the second driving source 202, and the third driving source 203 are started in sequence. FIG. 8 is different from FIG. 4 in that FIG. 8 shows a rotation state LOCK signal. The DC brushless motor is capable of providing a rotation state LOCK signal that indicates a rotation state detected. When rotation of the motor is stabilized, a value of the rotation state LOCK signal is changed and fixed. Since rotation being stabilized means that the starting current is stabilized, when the value of the rotation state LOCK signal is fixed, it can be determined that the starting current is stabilized.

Figure 8:
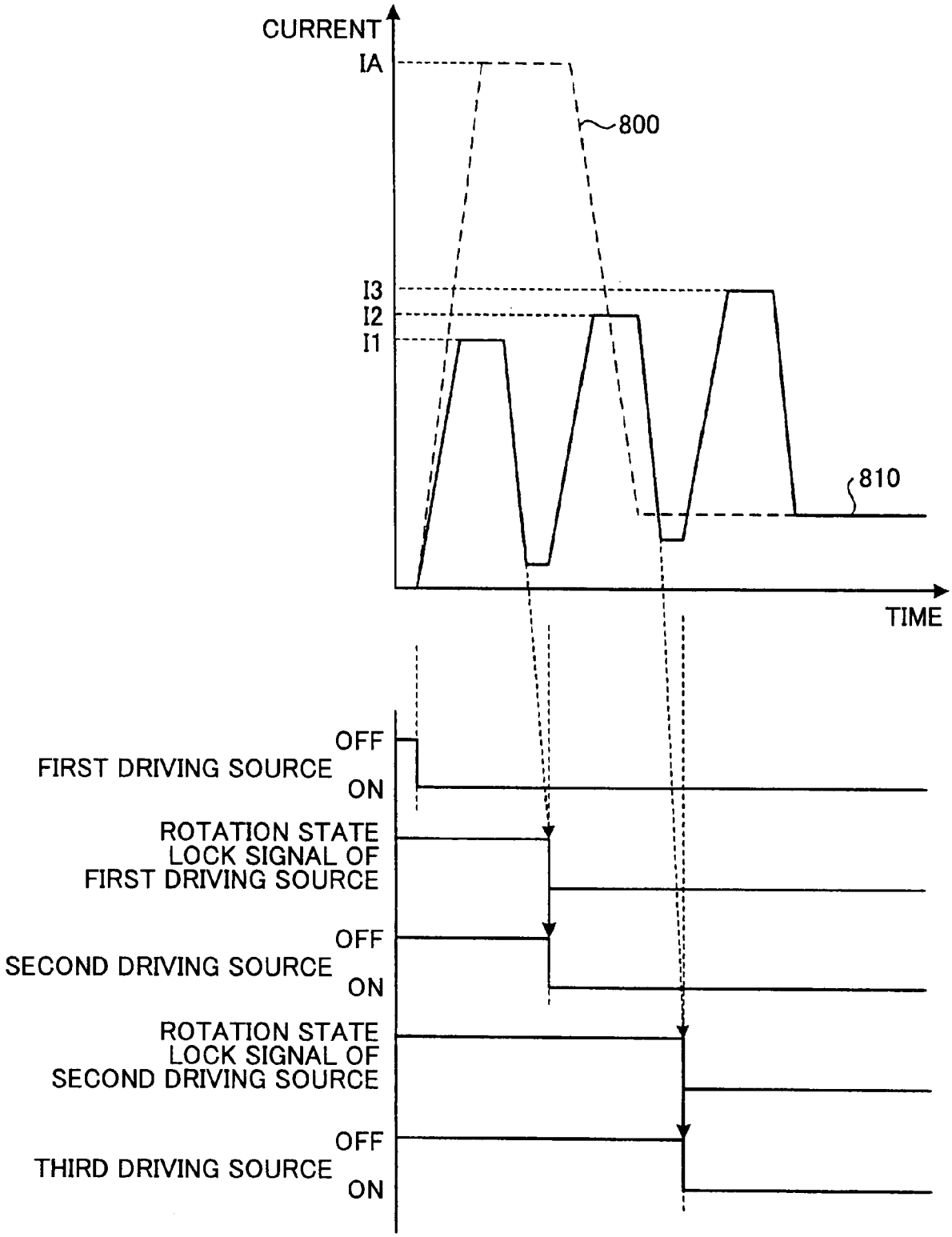
FIG. 8 is a graph showing an example of the currents flowing through the driving sources when a DC brushless motor is used.

According to the process shown in FIG. 8, when the rotation state LOCK signal of the first driving source 201 is stabilized after starting the first driving source 201, the second driving source 202 is started. When, the rotation state LOCK signal of the second driving source 202 is stabilized, the third driving source 203 is started. That is, only when the starting current of a driving source is stabilized, the next driving source is started. Accordingly, the current value I1 when starting the first driving source 201, the current value I2 when starting the second driving source 202, and the current value I3 when starting the third driving source 203 are less than the current value IA that is required when simultaneously starting all the driving sources.

In this way, the total current requirement of the image formation apparatus 100 is minimized, and a power source having a small output current capacity can serve the purpose without causing a shutdown due to an excessive current when starting the driving sources.

As described above, according to the image formation apparatus, the image formation method, the image formation program, and the recording medium, the output current capacity of the power source can be small; therefore, power-source cost can be minimized, because the driving sources are sequentially started in turn according to the situations. Here, a shutdown due to the excessive current draw when starting the driving sources is prevented without delaying the printing operations.

The embodiment of the present invention further provides a computer executable program for realizing the image formation method described above. Further, the embodiment provides a recording medium that is computer readable and executable, such as a hard disk, a flexible disk, a CD-ROM disk, a MO disk, and a DVD disk, which recording medium stores the program.

AVAILABILITY TO INDUSTRY

As described above, the image formation apparatus, the image formation method, the image formation program, and the recording medium according to the present invention are useful to digital copiers such as a copier, a facsimile apparatus, and a printer, and especially to a color copier.

Further, the present invention is not limited to these embodiments, but variations and modifications may be made without departing from the scope of the present invention.

The present application is based on Japanese Priority Application No. 2006-199470 filed on Jul. 21, 2006 with the Japanese Patent Office, the entire contents of which are hereby incorporated by reference.

What is claimed is:

1. An image formation apparatus, comprising:

a first driving source for driving a feed roller and a fixing unit;

a second driving source for driving at least one photo conductor out of a plurality of the photo conductors and a middle transfer belt;

a third driving source for driving the photo conductors other than the photo conductor driven by the second driving source;

a temperature detecting unit for detecting a temperature of the fixing unit, and for determining whether the temperature is greater than a predetermined threshold value; and a control unit for starting the first driving source, the second driving source, and the third driving source in this sequence if the temperature detecting unit determines that the temperature of the fixing unit is greater than the predetermined threshold value.

2. The image formation apparatus as claimed in claim 1, further comprising:

a current detecting unit for detecting a current flowing through the first driving source, the second driving source, and the third driving source, and for determining whether the current is stabilized; wherein the control unit starts driving the first driving source, the second driving source, and the third driving source in this sequence every time the current flowing through the corresponding preceding driving source is determined to have been stabilized if the temperature detecting unit determines that the temperature of the fixing unit is greater than the predetermined threshold value.

3. The image formation apparatus as claimed in claim 1, wherein the control unit starts driving the second driving source, the third driving source, and the first driving source in this sequence if the temperature detecting unit determines that the temperature of the fixing unit is less than the predetermined threshold value.

4. The image formation apparatus as claimed in claim 1, wherein the control unit starts driving the second driving source and the first driving source in this sequence if a monochrome printing request is received.

5. The image formation apparatus as claimed in claim 1, wherein the control unit starts driving the second driving source, the third driving source, and the first driving source in this sequence if a color printing request is received.

6. The image formation apparatus as claimed in claim 1, wherein each of the first driving source, the second driving source, and the third driving source includes a DC brushless motor.

7. An image formation method for an image formation apparatus that includes a first driving source for driving a feed roller and a fixing unit, a second driving source for driving at least one photo conductor out of a plurality of the photo conductors and a middle transfer belt, and a third driving source for driving the photo conductors other than the photo conductor driven by the second driving source drive, the image formation method comprising:

a step of detecting a temperature of the fixing unit and a step of determining whether the temperature is greater than a predetermined threshold value; and a control step of starting the first driving source, the second driving source, and the third driving source in this sequence if the temperature of the fixing unit is determined to be greater than the predetermined threshold value.

8. The image formation method as claimed in claim 7, further comprising:

a step of detecting a current flowing through the first driving source, the second driving source, and the third driving source, and a step of determining whether the current is stabilized; wherein in the control step driving is started for the first driving source, the second driving source, and the third driving source in this sequence every time the current flowing through the corresponding preceding driving source is determined to have been stabilized if the temperature of the fixing unit is determined to be greater than the predetermined threshold value.

9. The image formation method as claimed in claim 7, wherein in the control step driving is started for the second driving source, the third driving source, and the first driving source in this sequence if the temperature of the fixing unit is determined to be less than the predetermined threshold value.

10. The image formation method as claimed in claim 7, wherein in the control step driving is started for the second driving source, and the first driving source in this sequence if a monochrome printing request is received.

11. The image formation method as claimed in claim 7, wherein in the control step driving is started for the second driving source, the third driving source, and the first driving source in this sequence if a color printing request is received.

12. The image formation method as claimed in claim 7, wherein each of the first driving source, the second driving source, and the third driving source includes a DC brushless motor.

13. A computer readable medium having thereon a computer-executable program for carrying out an image formation method for an image formation apparatus that includes a first driving source for driving a feed roller and a fixing unit, a second driving source for driving at least one photo conductor out of a plurality of the photo conductors and a middle transfer belt, and a third driving source for driving the photo conductors other than the photo conductor driven by the second driving source drive, the method comprising:

a step of detecting a temperature of the fixing unit, and a step of determining whether the temperature is greater than a predetermined threshold value; and a control step of starting the first driving source, the second driving source, and the third driving source in this sequence if the temperature of the fixing unit is determined to be greater than the predetermined threshold value.

14. The computer readable medium as claimed in claim 13, further comprising:

a step of detecting a current flowing through the first driving source, the second driving source, and the third driving source, and a step of determining whether the current is stabilized; wherein in the control step driving is started for the first driving source, the second driving source, and the third driving source in this sequence every time the current flowing through the corresponding preceding driving source is determined to have been stabilized if the temperature of the fixing unit is determined to be greater than the predetermined threshold value.

15. The computer readable medium as claimed in claim 13, wherein in the control step driving is started for the second driving source, the third driving source, and the first driving source in this sequence if the temperature of the fixing unit is determined to be less than the predetermined threshold value.

16. The computer readable medium as claimed in claim 13, wherein in the control step driving is started for the second driving source and the first driving source in this sequence if a monochrome printing request is received.

17. The computer readable medium as claimed in claim 13, wherein in the control step driving is started for the second driving source, the third driving source, and the first driving source in this sequence if a color printing request is received.

18. The computer readable medium as claimed in claim 13, wherein each of the first driving source, the second driving source, and the third driving source includes a DC brushless motor.

* * * * *